US012742328B2

(12) United States Patent
Kuelker

(10) Patent No.: US 12,742,328 B2
(45) Date of Patent: Sep. 22, 2026

(54) PRECAST CONCRETE EXTERIOR CLADDING PANELS WITH PROFILED PANEL EDGES

(71) Applicant: Peter Kuelker, Calgary (CA)

(72) Inventor: Peter Kuelker, Calgary (CA)

( * ) Notice: Subject to any disclaimer, the term of this patent is extended or adjusted under 35 U.S.C. 154(b) by 0 days.

(21) Appl. No.: 17/704,992

(22) Filed: Mar. 25, 2022

(65) Prior Publication Data

US 2022/0307269 A1 Sep. 29, 2022

Related U.S. Application Data

(60) Provisional application No. 63/166,950, filed on Mar. 26, 2021.

(51) Int. Cl.

| | |
|---|---|
| ***E04F 13/00*** | (2006.01) |
| ***E04F 13/08*** | (2006.01) |
| ***E04F 13/14*** | (2006.01) |
| ***E04F 19/06*** | (2006.01) |

(52) U.S. Cl.

CPC ..... *E04F 13/007* (2013.01); *E04F 13/0871* (2013.01); *E04F 13/14* (2013.01); *E04F 19/061* (2013.01); *E04F 13/141* (2013.01)

(58) Field of Classification Search

CPC ..... E04F 13/007; E04F 13/0871; E04F 13/14; E04F 19/061; E04F 2201/0107; E04F 13/0894; E04F 13/141

USPC ..... 52/302.3, 302.4, 302.7

See application file for complete search history.

(56) References Cited

U.S. PATENT DOCUMENTS

| | | | | | |
|---|---|---|---|---|---|
| 814,134 | A * | 3/1906 | Hood | E04B 2/58 | 52/489.1 |
| 900,753 | A * | 10/1908 | Mahler | E04B 2/42 | 52/302.7 |
| 1,156,753 | A * | 10/1915 | Carey | E04F 15/04 | 52/592.1 |
| 1,203,934 | A * | 11/1916 | Straight | E04C 1/392 | 52/302.4 |

(Continued)

OTHER PUBLICATIONS

Wikipedia entry for "Cladding (construction)", downloaded Jul. 24, 2025.

(Continued)

*Primary Examiner* — Phi D A

(74) *Attorney, Agent, or Firm* — Donald V. Tomkins

(57) ABSTRACT

A precast cladding panel has upper and lower edges that, as viewed in transverse vertical cross-section through the panel, are profiled for overlapping engagement with complementarily-profiled edges of vertically-adjacent cladding panels in a coplanar cladding panel assembly mounted to a supporting structure. The upper edge of the panel defines a convex horizontal ridge, and the lower edge of the panel defines a concave horizontal recess, such that the convex horizontal ridge on the upper edge of one panel will project into the concave recess of the lower edge of a similar panel mounted immediately above it. The convex configuration of the upper edge of the panel promotes drainage of water out of horizontal joints between panels in the mounted assembly of cladding panels, and the overlapping engagement of vertically-adjacent panels impedes or prevents the entry of wind-driven rain into the cladding structure via the horizontal joints between panels.

7 Claims, 3 Drawing Sheets

(56) References Cited

U.S. PATENT DOCUMENTS 1,900,457 A * 3/1933 Miller ..... E04B 2/42 52/437
1,939,528 A * 12/1933 Swift ..... E04B 2/56 52/592.4
1,993,294 A * 3/1935 Blackman ..... E04F 13/14 52/436
2,011,510 A * 8/1935 Ackenbrack ..... E04F 13/0846 52/385
2,021,922 A * 11/1935 Peck ..... E04C 2/043 52/592.1
2,200,649 A * 5/1940 Wardle ..... E04F 13/085 52/715
2,317,428 A * 4/1943 Anderson ..... E04F 13/0846 52/592.4
2,961,803 A * 11/1960 Shapiro ..... E04F 15/14 52/302.7
2,969,617 A * 1/1961 Michelier ..... E04C 2/044 52/302.3
3,740,909 A * 6/1973 Stinnes ..... E04B 1/70 52/302.1
4,388,361 A * 6/1983 Vassalli ..... B29C 44/1233 428/192
4,407,104 A * 10/1983 Francis ..... E04C 2/041 52/592.1
4,553,366 A * 11/1985 Guerin ..... E04F 13/0805 52/506.08
4,641,473 A * 2/1987 Trezza ..... E04F 13/0846 52/410
4,803,821 A * 2/1989 Funaki ..... E04F 13/0864 52/387
4,890,433 A * 1/1990 Funaki ..... E04F 13/0801 52/510
4,956,949 A * 9/1990 Francis ..... E04F 13/0821 52/391
5,277,009 A * 1/1994 Yamaguchi ..... E04F 13/0889 52/387
5,398,473 A * 3/1995 Chan ..... E04F 13/141 52/235
6,202,377 B1 * 3/2001 Krieger ..... E04F 13/0812 52/762
6,253,515 B1 * 7/2001 Kuelker ..... B28B 13/0215 52/506.05
9,464,442 B1 * 10/2016 Olczyk ..... E04F 13/144
9,903,124 B2 * 2/2018 Wolf ..... B29C 39/18
10,151,117 B2 * 12/2018 Kuelker ..... E04F 13/0851
2004/0040234 A1 * 3/2004 Davison ..... E04B 5/10 52/234

OTHER PUBLICATIONS

Wikipedia entry for "Siding (construction)", downloaded Jul. 24, 2025.

* cited by examiner

PRECAST CONCRETE EXTERIOR CLADDING PANELS WITH PROFILED PANEL EDGES

FIELD OF THE DISCLOSURE

The present disclosure relates in general to precast exterior cladding panels, and relates in particular to means for minimizing ingress of moisture through precast exterior cladding panel assemblies mounted to exterior vertical faces of supporting structures.

BACKGROUND

Precast panels of various sizes and shapes are widely used as exterior cladding on building walls, serving as components of building envelope systems intended to prevent infiltration of rain and outside air into the building. Precast exterior cladding panels are commonly made of concrete, but may also be made with other cast materials known in the construction field. Concrete exterior cladding panels are common on large structures such as office buildings, but they are also used on residential housing structures as an alternative to traditional exterior cladding materials such as wood siding, brick, stucco, cement board, and plastic siding boards.

Whether installed on large or small buildings, it is desirable for exterior cladding panels to be mounted in such a way that there will be a continuous air space between the rear (i.e., inner) faces of the panels and the supporting structure, while at the same time providing reliable structural support for the panels, both to transfer the vertical weight of the panels to the supporting structure and to provide anchorage against lateral forces (such as wind) that may act on the panels.

The purpose of the air space is to provide a passage through which any water or moisture vapour that gets behind the exterior cladding can be directed away from the building envelope before it infiltrates other parts of the building. Although caulking or other sealant materials are typically used to seal the spaces between exterior cladding panels, the possibility of moisture infiltration behind the cladding—as a result of vapour migration, direct penetration of rainwater (due to sealant deterioration or other factors), or leakage at roof-to-wall junctures—cannot be entirely eliminated. If such moisture is not removed from the building envelope fairly promptly, it will tend to migrate further into the building, potentially causing a variety of problems that could entail costly maintenance and repairs and could detract from the building's overall durability and value. Such problems may include drywall damage due to moisture absorption, rot and mold in wooden construction components (e.g., studs and sheathing), corrosion of non-rust-resistant construction hardware, and staining on interior building finishes.

When an air space is provided behind the cladding, moisture can run downward behind the cladding to exit points such as weepholes built into the cladding system at appropriate locations. The air space also facilitates or enhances air circulation behind the cladding, helping to remove moisture vapour before it can condense inside the wall structure, and helping to dry out any wall structure components that may have become damp due to moisture infiltration.

Although the provision of an air space between cladding panels and the face of the supporting structure can be effective in itself to prevent or mitigate problems that can result from infiltration of moisture into the wall structure as discussed above, it is also desirable to supplement the protection provided by the air space with means for preventing or impeding the entry of water into the wall structure in the first place, to the extent that it may be practically possible to do so. A common way of doing this, as previously described, is to seal the vertical and horizontal joints between adjacent cladding panels with caulking or other sealant materials, which can physically impede or prevent direct entry of wind-driven rain (or water from landscaping irrigation systems) into the air space, as well as deterring rainwater or snowmelt water that might be running down the exterior faces of cladding panels from being diverted through panel joints into the air space (such as by wind or other agencies). However, caulking and sealant materials are prone to deterioration resulting from prolonged exposure to ultraviolet (UV) radiation from the sun as well as other environmental factors, and thus will lose their sealing effectiveness over time and may require costly removal and replacement.

Some cladding panel systems do not have caulked or sealed joints, and therefore rely on effective drainage of any water that enters the air space between the cladding panels and the supporting structure. Such systems can be effective for that purpose, but they can also have the aesthetic drawback that the building paper or other moisture-resisting material typically applied to the exterior face of the support structure may be visible through the joints between the cladding panels.

Accordingly, there is a need for new means and methods for impeding the entry of moisture into a wall structure clad with precast panels, without the disadvantages and drawbacks of conventional cladding systems as discussed above.

BRIEF SUMMARY OF THE DISCLOSURE

The present disclosure teaches embodiments of typically (but not necessarily) rectilinear precast concrete cladding panels having upper and lower edges that, as viewed in transverse vertical cross-section through the panel, are profiled for overlapping engagement with complementarily-profiled edges of adjacent cladding panels in a coplanar cladding panel assembly mounted to a building wall or other supporting structure (coplanar in this context meaning that the exposed outer faces of the mounted cladding panels lie in a common plane, which could be a slightly curved plane depending on the geometry of the supporting structure). In one embodiment of a cladding panel in accordance with the present disclosure, the panel has a convex upper edge defining a convex horizontal ridge, and a concave lower panel edge defining a concave horizontal recess, such that the convex horizontal ridge on the upper edge of one panel will project into the concave recess of the lower edge of a similar panel mounted immediately above it.

The transverse profiles of the convex ridge on the upper edges of the panels and the transverse profiles of the concave recess on the lower edges of the panels extend from the outer faces of the panels to the inner faces of the panels. The transverse profiles of the convex ridge and the concave recess may be identical (for example, having circular curvatures of the same radius), but this is not essential, and embodiments of cladding panels in accordance with the present disclosure are not limited to or restricted to any particular cross-sectional configurations of the convex horizontal ridge of the upper panel edge and the concave horizontal recess of the lower panel edge. By way of non-limiting example, the convex horizontal ridge and the concave horizontal ridge could both be of circular curvature but with different radii. In other variant embodiments, the convex horizontal ridge and the concave horizontal ridge could be of elliptical curvature, with either matching or non-matching geometries. In other variants, the respective convexity and concavity of the convex and concave horizontal ridges could be defined in whole or in part by straight lines.

Optionally, cladding panels in accordance with the present disclosure may have convex and concave vertical side edges similar to the convex upper edges and concave lower edges described above. In some embodiments, some panels may have a convex side edge on one side and a concave side edge on the other side, allowing a plurality of these panels to be mounted horizontally adjacent to each other on a supporting wall. In other embodiments, a first panel variant may have convex side edges on both sides, and a second variant may have concave side edges on both sides some panels, in which case these two panel variants would alternate with each other along a horizontal row of panels mounted on the supporting wall. Regardless of whether the panels have concave edges on both sides, convex edges on both sides, or a concave edge on one side and a convex edge on the other side, the overlap of a concave side edge profile on one panel with a convex side edge profile on the adjacent panel can also provide a beneficial measure of lateral stability during the panel installation process.

The vertical spacing between vertically-adjacent panels in accordance with the present disclosure, when mounted on a supporting wall, may be varied as a given user or installer might prefer. In general, however, it is desirable to keep the vertical gap between vertically-adjacent panels as low as manufacturing tolerances reasonably permit, in order to maximize the vertical overlap of the concave horizontal recesses in the lower edges of the panels with the convex horizontal ridges on the upper edges of the panels (and thus most effectively provide a physical barrier to the entry of wind-driven rain through the horizontal panel joints), while avoiding direct contact that might induce undesired load transfer between vertically-adjacent panels. This objective may best be achieved by mounting the panels to the supporting wall using panel hangers that carry the full weight of the panels and transfer that weight directly into the supporting wall. By way of non-limiting example, several embodiments of one type of panel hanger suitable for this purpose are disclosed in U.S. Pat. No. 10,151,117.

It is also desirable for the gap between horizontally-adjacent panels to be as small as possible to provide the most effective physical barrier to entry of wind-driven rain through the vertical panel joints. The only practical constraints in this regard are panel manufacturing tolerances and the need to provide a minimal space between horizontally-adjacent panels to prevent undesirable contact and compressive load transfer between horizontally-adjacent panels due to temperature-induced horizontal expansion of the panels during hot weather. The physical barrier thus provided for purposes of preventing water entry through the panel joints has the additional benefit of making it difficult, if not impossible, to see the supporting structure, and the building paper applied to the exterior face thereof, through the panel joints.

In addition to providing a physical barrier to wind-driven rain, the configuration of the upper and lower edges of cladding panels in accordance with the present disclosure beneficially promotes drainage of water that does enter the horizontal joints between vertically-adjacent panels, toward the exterior faces of the panels and away from the air space between the mounted panel assembly and the supporting structure. In conventional precast cladding panel systems, the upper edges of the panels are typically flat, at least in part. Accordingly, wind-driven rain or landscaping irrigation can cause water to accumulate on flat surfaces of the upper edges of the panels, without being able to drain out of the joints by gravity; this is undesirable, particularly in panel assemblies having minimal space between vertically-adjacent panels, because water accumulating in the horizontal joints can freeze and thus induce vertical compression forces that can cause cracking or spalling of the panels. However, the convex configuration of the upper edges of cladding panels in accordance with the present disclosure readily induces drainage of water out of the horizontal panel joints, and thus minimizes or eliminates the risking of panel damage due to freezing.

Another practical benefit of cladding panels in accordance with the present disclosure is that the panels can be effectively "self-aligning" during installation, due to closely-mating engagement of the concave horizontal recess on the lower edge of each lower panel edge over the convex horizontal ridge on the upper edge of the panel below. Even though the panels may be supported by hangers mounted to the supporting structure so as to prevent vertical load transfer between vertically-adjacent panels, the panels will tend to come into temporary non-load-transferring contact during the panel installation process, tending to vertically align a panel being installed with the installed panel below it, such that the panels will remain vertically aligned without need for fasteners or adhesive for that purpose.

In alternative cladding panel designs, vertical alignment of the panels could be provided, at least in theory, by forming continuous or spaced key elements projecting upward from the upper panel edges into mating keyways or recesses formed in the lower edges of the panels above. However, this would typically require precise alignment of the panels during installation, as well as strict manufacturing tolerances to ensure that the exterior faces of vertically-adjacent panels are properly aligned. Moreover, key elements and keyways would be particularly difficult to form in the upper and lower edges of comparative thin cladding panels intended for residential construction. Such potential concerns are avoided by cladding panels in accordance with the present disclosure, as the concave/convex configuration of the upper and lower panel edges is more forgiving in terms of manufacturing tolerances than panels formed with key elements and keyways.

BRIEF DESCRIPTION OF THE DRAWINGS

Embodiments in accordance with the present disclosure will now be described with reference to the accompanying Figures, in which numerical references denote like parts, and in which.

DESCRIPTION

Figure 1:
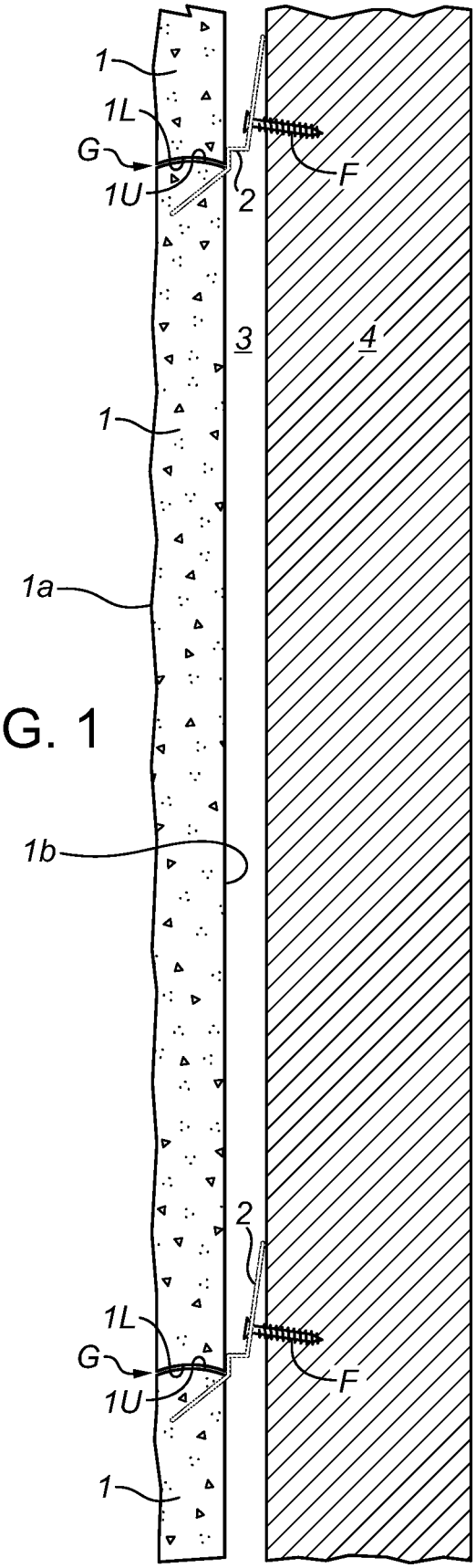
FIG. 1 is a vertical cross-section through an assembly of cladding panels in accordance with the present disclosure, mounted onto a supporting structure using panel hangers as described in U.S. Pat. No. 10,151,117. In this illustrated embodiment, the convex upper edges and concave lower edges of the cladding panels are of circular configuration as seen in cross-section.

FIG. 1 illustrates an assembly of precast cladding panels 1 in accordance with the present disclosure, mounted onto a vertical support structure 4 by means of panel hangers 2 (shown by way of non-limiting example as horizontal panel hangers disclosed in U.S. Pat. No. 10,151,117). In this exemplary assembly, panel hangers 2 are configured such that when embedded in cladding panels 1 and mounted to support structure 4 by means of suitable fasteners F as shown, a continuous air space 3 is formed between support structure 4 and cladding panels 1.

Figure 2A:
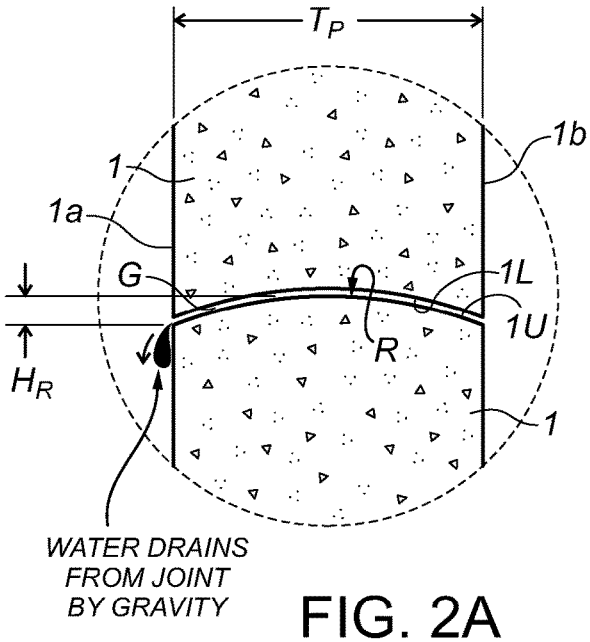
FIG. 2A is an enlarged sectional detail of a horizontal joint between two vertically-adjacent cladding panels of the assembly shown in FIG. 1, schematically illustrating the drainage of water from the joint by gravity, as induced by the convex profile of the upper edge of the lower panel.
Figure 2B:
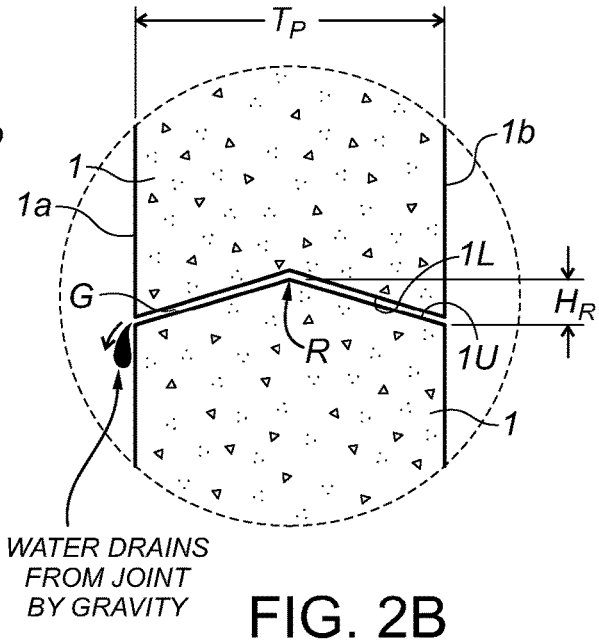
FIG. 2B is an enlarged sectional detail similar to FIG. 2A except that the convex upper edges and concave lower edges of the cladding panels define a triangular profile as seen in cross-section.
Figure 2C:
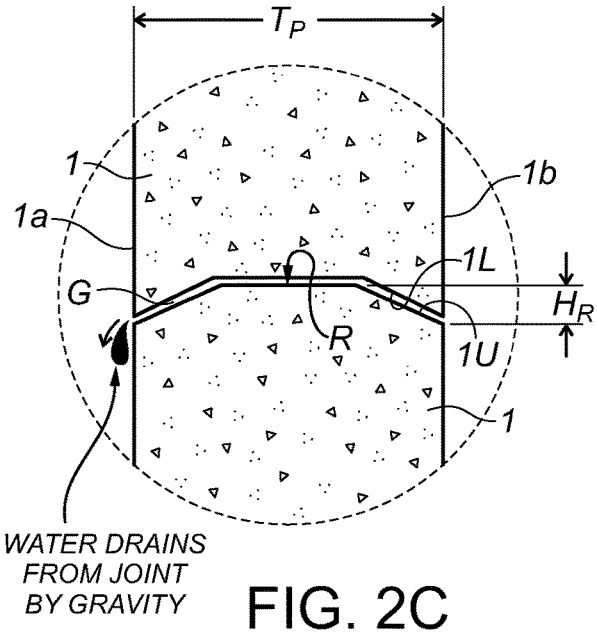
FIG. 2C is an enlarged sectional detail similar to FIG. 2B except that the convex upper edges and concave lower edges of the cladding panels define a trapezoidal profile as seen in cross-section.

As seen in FIG. 1 and in enlarged detail in FIGS. 2A, 2B, and 2C, each cladding panel 1 has an outer panel face la, an inner panel face 1*b*, a panel thickness $T_P$, an upper panel edge 1U formed with a convex cross-sectional profile extending from outer panel face 1*a* to inner panel face 1*b*, and a lower panel edge 1L formed with a convex cross-sectional profile extending from outer panel face 1*a* to inner panel face 1*b*. The convex cross-sectional profile defines a horizontal ridge R having a height $H_R$ relative to the intersections of upper panel edge 1U with outer and inner panel faces 1*a* and 1*b*. In the particular embodiment illustrated in FIG. 2A, the ratio $H_R/T_P$ (ridge height to panel thickness) is approximately 0.10. When panels 1 are mounted onto support structure 4 as shown, the convex profile of lower panel edge 1L projects upward into the concave profile of upper panel edge 1U, with a vertical gap G between the two panels. Preferably, vertical gap G will be made as small as reasonably possible, allowing for manufacturing tolerances and other practical considerations, to minimize the vertical surface area through which water (such as from wind-driven rain or spray from landscaping irrigation equipment) might enter the horizontal joints between vertically adjacent panels 1 in the installed panel assembly, while still enabling effective drainage of water from the horizontal joints.

Figure 3A:
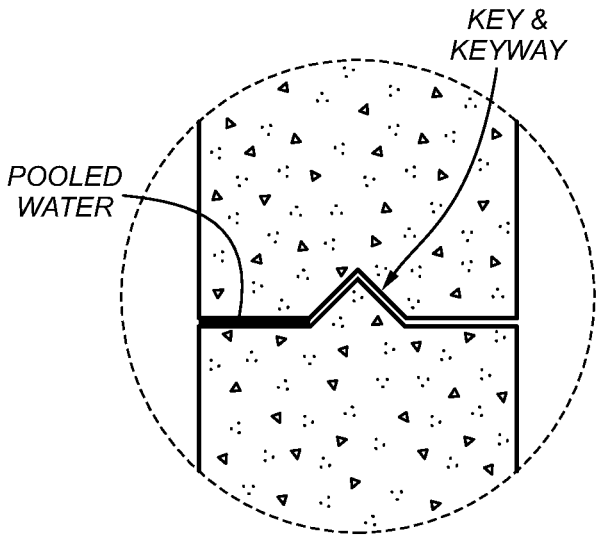
FIGS. 3A and 3B are enlarged sectional details of horizontal joints in mounted assemblies of possible styles of "keyed" cladding panels, illustrating the pooling of water on flat surfaces on the upper edges of the lower panels.
Figure 3B:
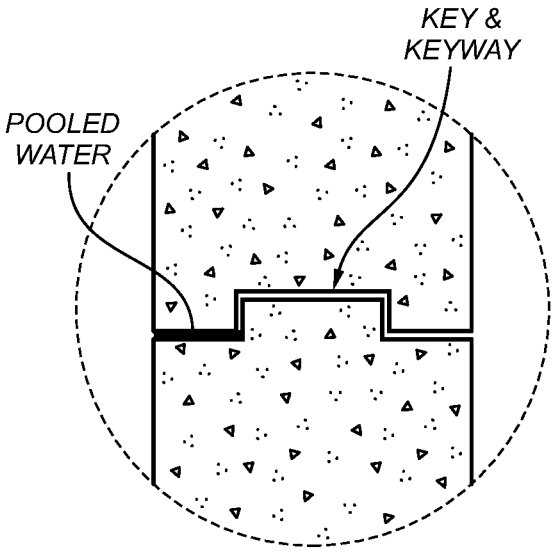
Figure 3C:
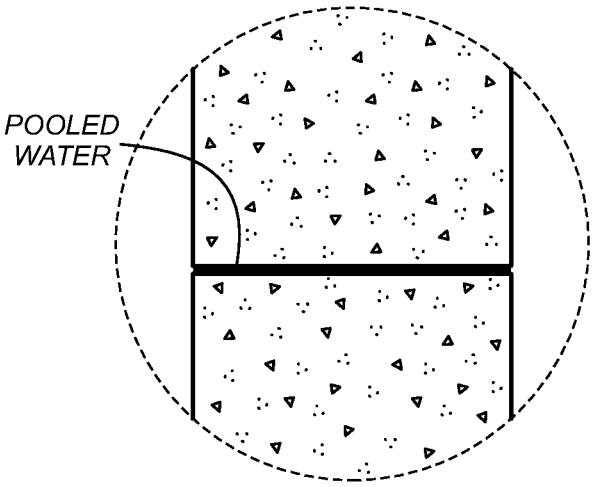
FIG. 3C (Prior Art)
FIG. 3C is an enlarged sectional detail of a horizontal joint in a mounted assembly of prior art cladding panels having flat upper and lower edges, illustrating the pooling of water on the flat surface of the upper edge of the lower panel.

However, if water does enter the horizontal joints between panels 1, it will tend to drain from the joints by gravity, as schematically illustrated in FIGS. 2A. 2B, and 2C, due to the convex profile on upper panel edges 1U. This is in contrast to cladding panels that have flat surfaces on their upper edges (as illustrated by way of example in FIGS. 3A, 3B, and 3C), and upon which water can pool with minimal if any tendency to drain out of the joints. As well, rainwater flowing down the outer faces of the panels, or condensation flowing down the inner faces of the panels, will be deterred from entering the horizontal panel joints by the convex profile of the upper panel edges 1U, and therefore will tend to continue flowing down the outer or inner panel faces (as the case may be) and can be drained away at the bottom of the cladding panel structure.

Preferably (but not necessarily), the convex profile of lower panel edge 1L and the concave profile of upper panel edge 1U are configured such that when looking directly at the horizontal joint between two cladding panels 1 in the plane of the joint, the convex profile of lower panel edge 1L will visually occlude or block the horizontal joint space between the panels, and thus make it difficult or impossible to see the supporting structure behind the panels.

FIGS. 2B and 2C illustrate exemplary alternative embodiments of cladding panels 1 in accordance with the present disclosure in which the convex profile of lower panel edge 1L and the concave profile of upper panel edge 1U are defined by straight lines rather than curved lines as in the embodiments shown in FIGS. 1 and 2A. In the particular embodiment illustrated in FIG. 2B, the ratio $H_R/T_P$ is approximately 0.20, and in the embodiment illustrated in FIG. 2C, the ratio $H_R/T_P$ is approximately 0.125.

It will be readily appreciated by those skilled in the art that various modifications to embodiments in accordance with the present disclosure may be devised without departing from the present teachings, including modifications that may use structures or materials later conceived or developed. It is to be especially understood that the scope of the present disclosure and claims should not be limited to or by any particular embodiments described, illustrated, and/or claimed herein, but should be given the broadest interpretation consistent with the disclosure as a whole. It is also to be understood that the substitution of a variant of a described or claimed element or feature, without any substantial resultant change in functionality, will not constitute a departure from the scope of the disclosure or claims.

In this patent document, any form of the word "comprise" is intended to be understood in a non-limiting sense, meaning that any element or feature following such word is included, but elements or features not specifically mentioned are not excluded. A reference to an element or feature by the indefinite article "a" does not exclude the possibility that more than one such element or feature is present, unless the context clearly requires that there be one and only one such element or feature. Any use of any form of any term describing an interaction between recited elements is not meant to limit the interaction to direct interaction between the elements in question, but may also extend to indirect interaction between the elements such as through secondary or intermediary structure.

Relational terms such as but not limited to "vertical", "horizontal", and "coplanar" are not intended to denote or require absolute mathematical or geometrical precision. Accordingly, such terms are to be understood as denoting or requiring substantial precision only (e.g., "generally vertical" or "substantially horizontal") unless the context clearly requires otherwise. Any use of any form of the term "typical" is to be interpreted in the sense of being representative of common usage or practice, and is not to be interpreted as implying essentiality or invariability.

What is claimed is:

1. An assembly of two precast concrete exterior cladding panels wherein:

(a) each of said precast concrete exterior cladding panels has an outer panel face, an inner panel face, a panel thickness, an upper panel edge, and a lower panel edge, wherein, when viewed in transverse cross-section:

(a.1) the upper panel edge has a convex profile that extends from the outer panel face to the inner panel face;

(a.2) the convex profile of the upper panel edge defines a horizontal ridge having a ridge height relative to the intersections of the upper panel edge with the outer panel face and the inner panel face;

(a.3) the ratio of the ridge height to the panel thickness is from 0.10 and 0.20; and (a.4) the lower panel edge has a concave profile that extends from the outer panel face to the inner panel face and is matingly engageable with the convex profile of the upper panel edge; and (b) said two precast concrete exterior cladding panels are mounted one above the other to a vertical support structure, said vertical support structure having an exterior face, such that:

(b.1) the full weight of each precast concrete exterior cladding panel is transferred directly into the vertical support structure by panel hanger means;

(b.2) a continuous air space is formed between the inner panel faces of the precast concrete exterior cladding panels and the exterior face of the vertical support structure;

(b.3) a vertical gap is provided between the two precast concrete exterior cladding panels, forming an unsealed horizontal joint space between the two cladding panels that prevents vertical load transfer between the two precast concrete exterior cladding cladding panels while enabling drainage of water from the horizontal joint space; and (b.4) the convex profile on the upper panel edge of the lower one of the two precast concrete exterior cladding panels extends into the concave profile on the lower edge of the upper one of the two precast concrete exterior cladding panels, so as to visually occlude the horizontal joint space between the two precast concrete exterior cladding panels; and (c) the outer panel faces of the two precast concrete exterior cladding panels are exposed to the weather.

2. The assembly as in claim 1 wherein the convex profile of the upper panel edge of each precast concrete exterior cladding panel is defined by one or more curved lines.

3. The assembly as in claim 2 wherein the one or more curved lines comprise a circular line.

4. The assembly as in claim 1 wherein the convex profile of the upper panel edge of each precast concrete exterior cladding panel is defined by two or more straight lines.

5. The assembly as in claim 1 wherein at least one of the precast concrete exterior cladding panels further has a first panel side edge and a second panel side edge, each having a convex profile that extends from the outer panel face to the inner panel face.

6. The assembly as in claim 1 wherein at least one of the precast concrete exterior cladding panels further has a first panel side edge and a second panel side edge, each having a concave profile that extends from the outer panel face to the inner panel face.

7. The assembly as in claim 1 wherein at least one of the precast concrete exterior cladding panels further has a first panel side edge having a convex profile that extends from the outer panel face to the inner panel face and a second panel side edge having a concave profile that extends from the outer panel face to the inner panel face.

* * * * *